US008107663B2

(12) United States Patent
Lin

(10) Patent No.: US 8,107,663 B2
(45) Date of Patent: Jan. 31, 2012

(54) HEADSET

(75) Inventor: You-Ruei Lin, Tu-Cheng (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 433 days.

(21) Appl. No.: 12/430,052

(22) Filed: Apr. 24, 2009

(65) Prior Publication Data

US 2010/0272303 A1 Oct. 28, 2010

(51) Int. Cl.
*H04R 25/00* (2006.01)

(52) U.S. Cl. ..... 381/371; 381/373; 181/133

(58) Field of Classification Search ..... 381/371, 381/373; 181/133
See application file for complete search history.

(56) References Cited

U.S. PATENT DOCUMENTS 3,826,333 A * 7/1974 Buckwalter ..... 181/153
4,027,116 A * 5/1977 Nakamura ..... 381/346
6,826,287 B2 * 11/2004 Myers ..... 381/373
2005/0105755 A1 * 5/2005 Yueh ..... 381/371
2006/0153414 A1 * 7/2006 Liao ..... 381/371
2006/0256992 A1 * 11/2006 Liao ..... 381/371

FOREIGN PATENT DOCUMENTS

JP 05111086 A * 4/1993

OTHER PUBLICATIONS

Translation of JP 05111086 A, accessed Aug. 25, 2011.*

* cited by examiner

*Primary Examiner* — Jeremy Luks

(57) ABSTRACT

A headset has a hollow housing having a front wall with at least one sound hole formed thereon, and a rear wall facing the front wall having a plurality of air holes formed thereon. A loudspeaker unit is disposed in the housing and adjacent to the sound hole. An adjustive component is rotatably mounted to the rear wall of the housing. The adjustive component has an adjustive switch outside the rear wall and a blocking slice against an inner surface of the rear wall and connected with the adjustive switch. The adjustive switch is capable of controlling the blocking slice to swing and halt repetitiously, for altering the number of the covered air holes when the adjustive switch is driven to rotate.

3 Claims, 4 Drawing Sheets

HEADSET

BACKGROUND OF THE INVENTION

1. Field of the Invention

The present invention relates to a headset, and more particularly to a headset that allows a user to adjust the frequency response of the headset in use.

2. The Related Art

Headsets are widely applied in a variety of fields, such as telecommunication, computer based-telephony, audio entertainment and the like, providing audio information related to the application domain to a headset user. Since sound chambers of the headsets are either open or closed, which has influence upon the sound quality of the headsets, the headsets are generally classified in two types, open headsets and closed headsets. FIGS. 1-2 illustrate an open headset 100' in prior art. The headset 100' includes a cylindraceous housing 1' having an opening, a cover 3' sealed to the opening of the housing 1' to form a sound chamber 4', and a loudspeaker unit 2' located in the sound chamber 4' and adjacent to the cover 3'. The cover 3' has a plurality of sound holes 31' for giving the sound off. A wall of the housing 1' facing the cover 3' has at least one air hole 11', as a passage for making the sound chamber 4' communicating with outer environment. However, as the number of the air holes 11' on the headset 100' is invariable in manufacture, that is, the frequency response of the headset 100' can not be adjusted for gaining different sound quality, without breaking the construction and providing with additional electronic unit. Consequently, the customers using the headsets 100' only hear a kind of the sound quality, which cannot meet different favors of the customers. Therefore, it is desirable to design a headset of which the sound quality can be changed in use in accordance with the favors of the customers.

SUMMARY OF THE INVENTION

Accordingly, an object of the present invention is to provide a headset that allows a user to adjust the frequency response of the headset in use for gaining the different sound quality. The headset has a hollow housing having a front wall with at least one sound hole formed thereon, and a rear wall facing the front wall having a plurality of air holes formed thereon. A loudspeaker unit is disposed in the housing and adjacent to the sound hole. An adjustive component is rotatably mounted to the rear wall of the housing. The adjustive component has an adjustive switch outside the rear wall and a blocking slice against an inner surface of the rear wall and connected with the adjustive switch. The adjustive switch is capable of controlling the blocking slice to swing and halt repetitiously, for altering the number of the covered air holes when the adjustive switch is driven to rotate.

As described above, the headset is provided with the adjustive component. The adjustive switch is capable of controlling the blocking slice to cover and depart from the air holes, so as to alter the number of the air holes of the headset, in use. Since the number of the air holes has influence on the frequency response of the headset, the user can adjust the frequency response of the headset by rotating the adjustive switch for gaining the different sound quality.

BRIEF DESCRIPTION OF THE DRAWINGS

The present invention will be apparent to those skilled in the art by reading the following description, with reference to the attached drawings, in which.

DETAILED DESCRIPTION OF THE EMBODIMENT

Figure 1:
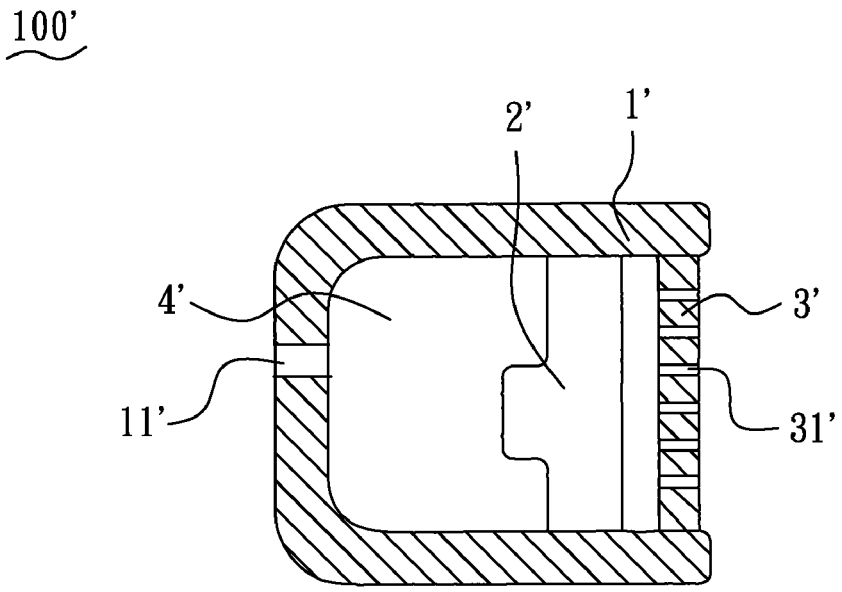
FIG. 1 ( Prior Art )
FIG. 1 is a cross-sectional view of a headset in prior art.
Figure 2:
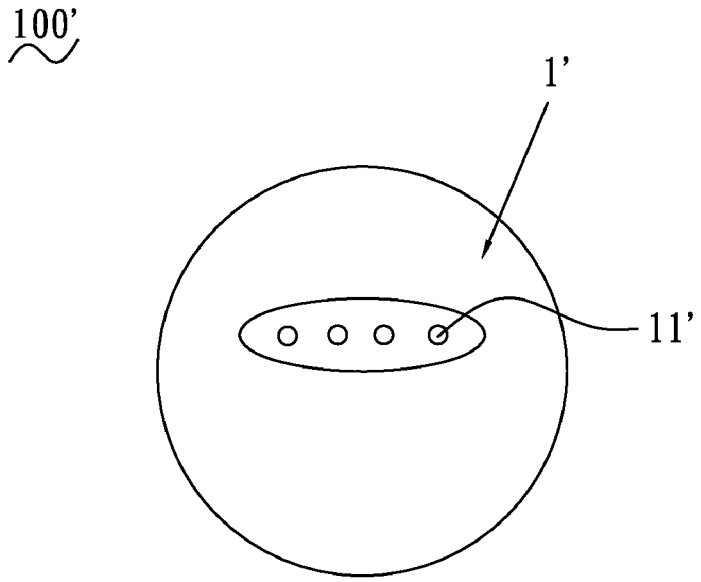
FIG. 2 ( Prior Art )
FIG. 2 is a plan view of the headset shown in FIG. 1 viewed from a rear angle.
Figure 3:
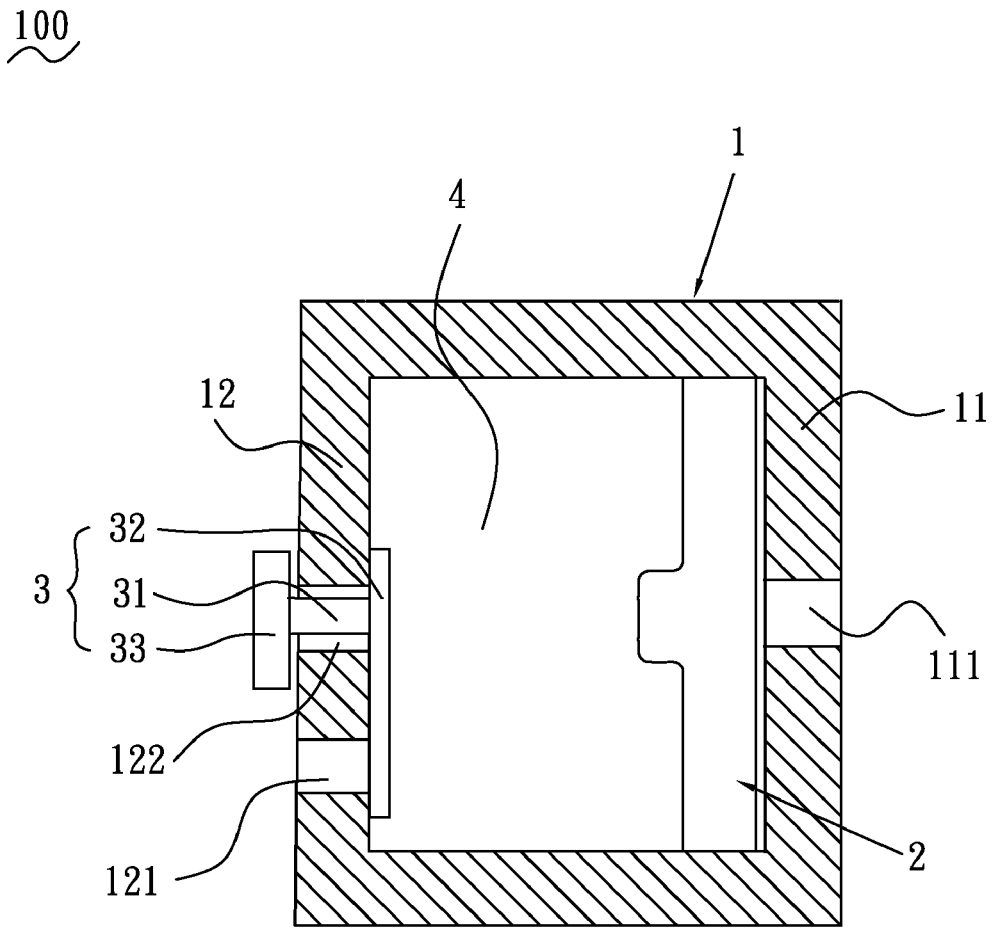
FIG. 3 is a cross-sectional view of a headset of an embodiment according to the present invention.

Referring to the drawings in greater detail, and first to FIG. 3, the embodiment of the invention is embodied in a headset 100. The headset 100 includes a housing 1, a loudspeaker unit 2 and an adjustive component 3. The housing 1 is formed to show a closed cylindraceous shape and defines a front wall 11 and a rear wall 12 facing the front wall 11. The front wall 11 has at least one sound hole 111 for giving the sound off. The loudspeaker unit 2 is located in a sound chamber 4 formed by the housing 1 and disposed adjacent to the sound hole 111. The rear wall 12 has a plurality of air holes 121. In this embodiment, there are four air holes 121 which are arranged substantially in a way of arc line and adjacent to an edge of the rear wall 12 (see FIG. 5). An installing hole 122 is located at a center of the rear wall 12 for mounting the adjustive component 3.

Figure 4:
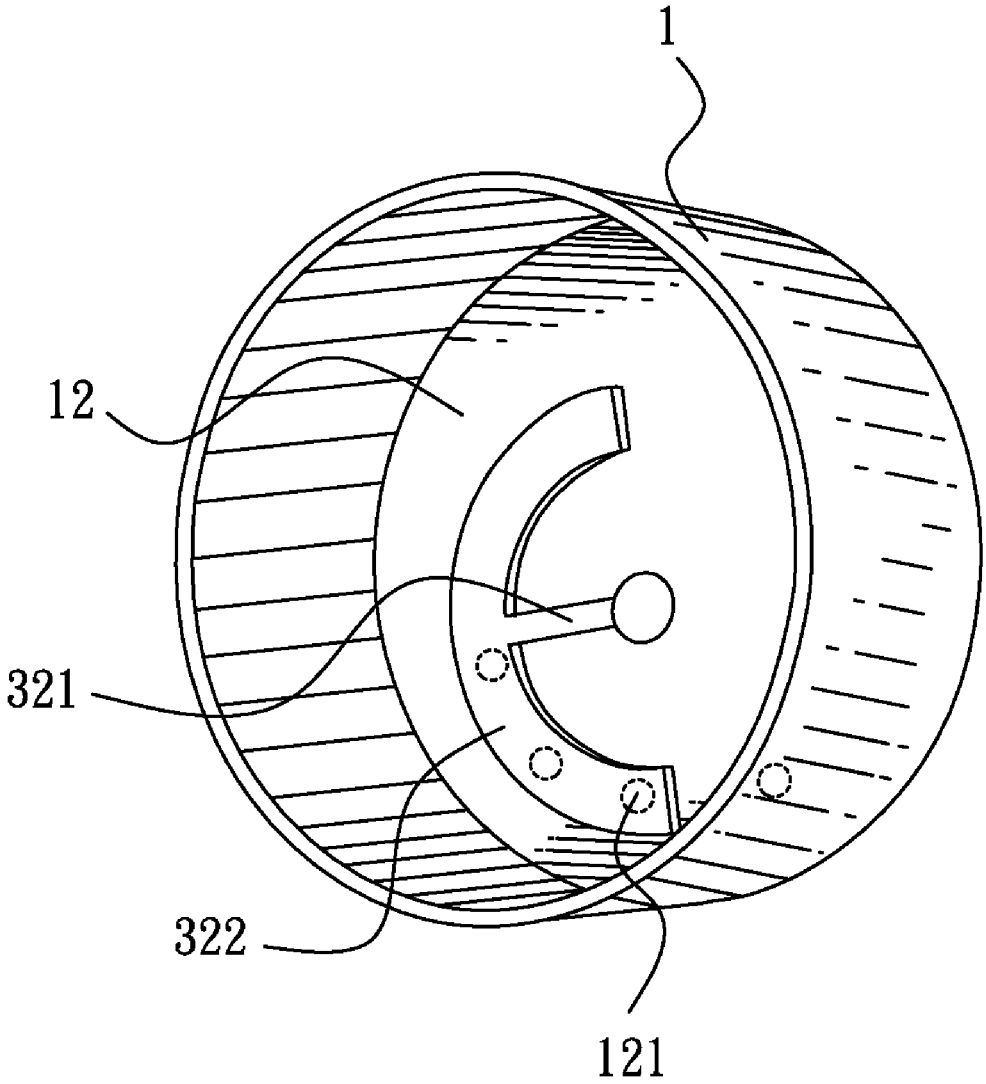
FIG. 4 is a perspective view of the headset shown in FIG. 3, wherein a front wall of the headset and a loudspeaker unit are removed.

With reference to FIGS. 3-4, the adjustive component 3 includes a main body 31 of column shape, an adjustive switch 33 of circular flat-board shape connected to one end of the main body 31, and a blocking element 32 connected to the other end of the main body 31. The main body 31 is rotatably mounted in the installing hole 122 of the rear wall 12. The adjustive switch 33 is located outside the rear wall 12 for conveniently manual operation and preventing the main body 31 from moving towards the front wall 11. The blocking element 32 has a beam 321 of which one end is connected with the end of the main body 31 opposite to the adjustive switch 33, and a substantial half-ring blocking slice 322 connected with the beam 321 by the other end of the beam 321 fixed with a middle portion of an inner side of the blocking slice 322. The blocking slice 322 stands against an inner surface of the rear wall 12 for blocking the air holes 121. In this embodiment, the adjustive switch may be connected with the blocking element in a way of screw link, which makes the adjustive switch control the blocking element to swing by way of stepless regulation, or in a way of step-fixed link, which makes the adjustive switch control the blocking element to swing by way of plural steps.

Figure 5:
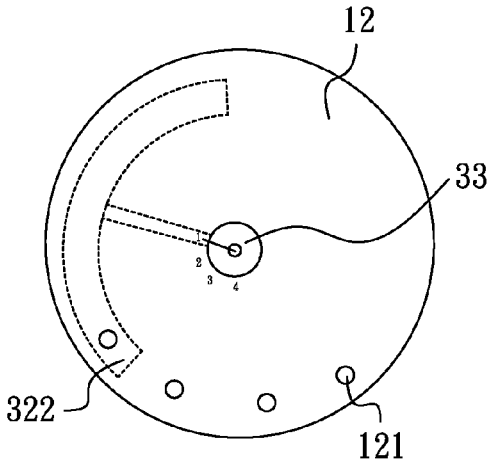
FIG. 5 is a plan view of the headset shown in FIG. 3 viewed from a rear angle, wherein one of air holes is blocked.
Figure 6:
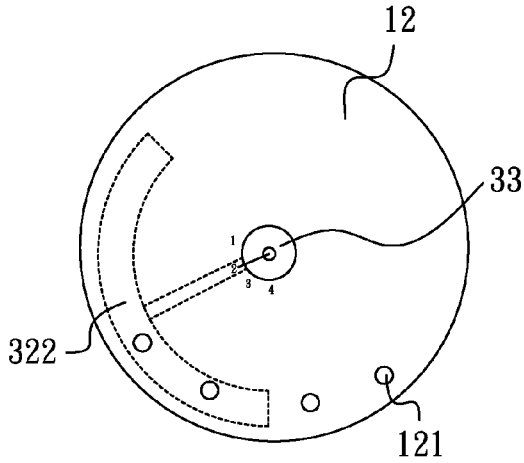
FIG. 6 is a plan view of the headset shown in FIG. 3 viewed from the rear angle, wherein two of the air holes are blocked.
Figure 7:
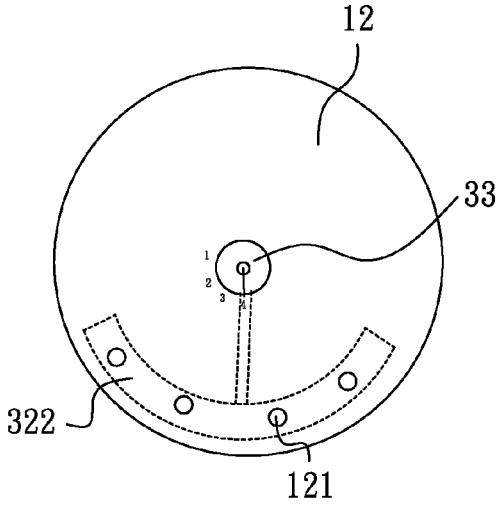
FIG. 7 is a plan view of the headset shown in FIG. 3 viewed from the rear angle, wherein all of the air holes are blocked.

Referring to FIGS. 5-7, the rear wall 12 is formed with four air holes 121 in this embodiment. Accordingly, the adjustive switch 33 is set to be four available steps, generally designated 1, 2, 3, and 4. The adjustive switch 33 may be firstly located in an original position where the air holes 121 are not blocked by the blocking slice 322. When the adjustive switch 33 is rotated to the step 1, the blocking slice 322 is driven to swing and cover one of the air holes 121, in turn, the air holes 121 are blocked by the blocking slice 322 one after another, with the adjustive switch 33 adjusted to the corresponding step 2, 3, and 4, respectively. Herein, when the adjustive switch 33 is rotated to the step 4, the headset 100 is switched from the open headset to the closed headset because all of the air holes 121 are blocked by the blocking slice 322.

As described above, the headset 100 is provided with the adjustive component 3. The adjustive switch 33 is capable of controlling the swinging motion of the blocking slice 322 to alter the number of the air holes 121 of the headset 100, in use. Since the number of the air holes 121 has influence on the frequency response of the headset 100, the user can adjust the frequency response of the headset 100 by rotating the adjustive switch 33 in order to gain the different sound quality.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A headset, comprising:

a hollow housing having a front wall with at least one sound hole formed thereon, and a rear wall facing the front wall having a plurality of air holes formed thereon;

a loudspeaker unit disposed in the housing and adjacent to the sound hole; and an adjustive component rotatably mounted to the rear wall of the housing, the adjustive component having an adjustive switch outside the rear wall and a blocking slice against an inner surface of the rear wall and connected with the adjustive switch, the adjustive switch capable of controlling the blocking slice to swing and halt repetitiously, for altering the number of the covered air holes when the adjustive switch is driven to rotate;

wherein the adjustive component has a main body of column shape and a blocking element, the main body passes through an installing hole defined at a substantially middle portion of the rear wall, the adjustive switch is connected with one end of the main body, the blocking element has a beam of which one end is connected with the other end of the main body, and the blocking slice is of substantially half-ring shape and connected with the other end of the beam by a middle portion of an inner side of the blocking slice.

2. The headset as claimed in claim 1, wherein the housing is of closed cylindraceous shape, the air holes are arranged substantially in a way of arc line and adjacent to an edge of the rear wall, corresponding to the blocking slice.

3. The headset as claimed in claim 1, wherein the adjustive switch is set to stepwise control the number of the air holes blocked by the blocking slice.

* * * * *